US007577564B2

(12) United States Patent
Wenndt et al.

(10) Patent No.: US 7,577,564 B2
(45) Date of Patent: Aug. 18, 2009

(54) METHOD AND APPARATUS FOR DETECTING ILLICIT ACTIVITY BY CLASSIFYING WHISPERED SPEECH AND NORMALLY PHONATED SPEECH ACCORDING TO THE RELATIVE ENERGY CONTENT OF FORMANTS AND FRICATIVES

(75) Inventors: Stanley J. Wenndt, Rome, NY (US); Edward J. Cupples, Rome, NY (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 886 days.

(21) Appl. No.: 10/378,513

(22) Filed: Mar. 3, 2003

(65) Prior Publication Data

US 2004/0176949 A1 Sep. 9, 2004

(51) Int. Cl.
*G10L 19/02* (2006.01)

(52) U.S. Cl. ..... 704/203; 704/214; 704/208

(58) Field of Classification Search ..... 704/207–210, 704/214–215, 27, 203, 200, 204–205, 500, 704/218, 225, 267, 232, 234, 256, 254
See application file for complete search history.

(56) References Cited

U.S. PATENT DOCUMENTS 5,197,113 A * 3/1993 Mumolo ..... 704/200
5,924,066 A * 7/1999 Kundu ..... 704/232
7,065,485 B1 * 6/2006 Chong-White et al. ..... 704/208

OTHER PUBLICATIONS

Mahesh L. Chugani, Abhay R. Samant, and Michael Cerna, "LabVIEW Signal Processing" 1998 Prentice Hall PRT, ISBN 0-13-972449-4.*

J.B. Wilson and J. D. Masko "A Comparative Analysis of Whispered and Normally Phonated Speeh Using an LPC-10 Vocoder", RADC Final Report TR-85-264.*

* cited by examiner

*Primary Examiner*—Huyen X. Vo
(74) *Attorney, Agent, or Firm*—Joseph A. Mancini

(57) ABSTRACT

Method and apparatus for the classification of speech signals. Speech is classified into two broad classes of speech production—whispered speech and normally phonated speech. Speech classified in this manner will yield increased performance of automated speech processing systems because the erroneous results that occur when typical automated speech processing systems encounter non-typical speech such as whispered speech, will be avoided.

2 Claims, 3 Drawing Sheets

| SNR | # of Regions Correctly Classified | Percent Correctly Classified | Percent of Normal Speech Classified |
|---|---|---|---|
| 30 dB | 56 | 93.3% | 100% |
| 20 dB | 57 | 95.0% | 100% |
| 10 dB | 57 | 95.0% | 100% |
| 5 dB | 56 | 93.3% | 100% |

*Figure 3*

METHOD AND APPARATUS FOR DETECTING ILLICIT ACTIVITY BY CLASSIFYING WHISPERED SPEECH AND NORMALLY PHONATED SPEECH ACCORDING TO THE RELATIVE ENERGY CONTENT OF FORMANTS AND FRICATIVES

STATEMENT OF GOVERNMENT INTEREST

The invention described herein may be manufactured and used by or for the Government for governmental purposes without the payment of any royalty thereon.

BACKGROUND OF THE INVENTION

There exists a need to differentiate between normally phonated and whispered speech. To that end, literature searches have uncovered several articles on whispered speech detection. However, very little research has been conducted to classify or quantify whispered speech. Only two sources of work in this area are known and that work was conducted by Jovicic [1] and Wilson [2]. They observed that normally phonated and whispered speech exhibit differences in formant characteristics. These studies, in which Serbian and English vowels were used, show that there is an increase in formant frequency F1 for whispered speech for both male and female speakers. These studies also revealed a general expansion of formant bandwidths for whispered vowels as compared to voiced vowels. The results by Jovicic [1], which were computed using digitized speech data from five male and five female native Serbian speakers, show formant bandwidth increases over voice vowels for all five whispered vowels. However, the results by Wilson [2], which were computed using speech data from five male and five female Native American English speakers, show that the formant bandwidths are not consistently larger for whispered vowels. Therefore, developing a recognition process that solely relies on formant bandwidth would not appear to provide good results. In addition to the above work, Wilson [2] also showed that the amplitude for the first formant F1 was consistently lower in amplitude for whispered speech.

Although the results of this prior work clearly point out some differences between normally phonated and whispered speech, there has been no attempt to automatically distinguish between normally phonated and whispered speech.

REFERENCES

[1] Jovicic, S. T., "Formant Feature Difference Between Whispered and Voice Sustained Vowels," *Acoustica, Vol.* 84, 1998, pp. 739-743.

[2] Wilson, J. B., "A Comparative Analysis of Whispered and Normally Phonated Speech Using An LPC-10 Vocoder", *RADC Final Report TR*-85-264.

OBJECTS AND SUMMARY OF THE INVENTION

One object of the present invention is to provide a method and apparatus to differentiate between normally phonated speech and whispered speech.

Another object of the present invention is to provide a method and apparatus that classifies speech as normal speech or otherwise.

Yet another object of the present invention is to provide a method and apparatus that improves the performance of speech processors by reducing errors when such processors encounter whispered speech.

The invention described herein provides a method and apparatus for the classification of speech signals. Speech is classified into two broad classes of speech production—whispered speech and normally phonated speech. Speech classified in this manner will yield increased performance of automated speech processing systems because the erroneous results that occur when typical automated speech processing systems encounter non-typical speech such as whispered speech, will be avoided.

According to an embodiment of the present invention, a method for classifying whispered and normally phonated speech, comprising the steps of framing the input audio signal into data windows and advancing said windows; computing the magnitude of the data over a high frequency range; computing the magnitude of the data over a low frequency range; computing the ratio of the magnitude from the high frequency range to the magnitude from the low frequency range; and determining if the ratio is greater than 1.2; if said ratio is greater than 1.2, then labeling the audio signal as whispered speech, otherwise, labeling the audio signal as normally phonated speech.

According to the same embodiment of the present invention, a method for classifying whispered and normally phonated speech, further comprises the steps of framing 4.8 second windows and advancing at a rate of 2.4 seconds.

According to the same embodiment of the present invention, a method for classifying whispered and normally phonated speech, the step of computing the magnitude further comprises performing an N-point Discrete Fourier Transform that has starting and stopping points of $2800/(F_s/N)$ and $3000/(F_s/N)$ respectively, for the high frequency range and has starting and stopping points of $450/(F_s/N)$ and $650/(F_s/N)$ respectively, for the low frequency range, where $F_s$ is the sampling rate and N is the number of points in the N-point Discrete Fourier Transform.

Advantages and New Features

There are several advantages attributable to the present invention relative to prior art. An important advantage is the fact that the present invention provides performance improvement for conventional speech processors which would otherwise generate errors in speech detection when non-normally phonated speech is encountered.

A related advantage stems from the fact that the present invention can extend and improve military and law enforcement endeavors to include the content of communications that may be whispered.

Another advantage is the fact that the present invention may improve the quality of life for those handicapped persons who are in reliance of voice-activated technologies to compensate for their physical disabilities.

BRIEF DESCRIPTION OF THE DRAWINGS

FIG. 3 depicts test results for the classification of speech.

DETAILED DESCRIPTION OF THE PREFERRED EMBODIMENT

The application of these aforementioned differences in recognizing normal phonated speech from whispered speech in conversation presents several problems. One of the largest of these problems is the lack of reliable or stationary reference values for using these feature differences. If one attempts to exploit the formant frequency and amplitude differences of F1, it is found that these shifts can be masked by the shifts caused by different speakers, conversation content and widely varying amplitude levels between speakers, and/or different audio sources. Therefore, an analysis on the speech signals was conducted to look for reliable features and a measurement method that could be used on conversational normal and whisper speech, independent of the above sources of shift.

Figure 1A:
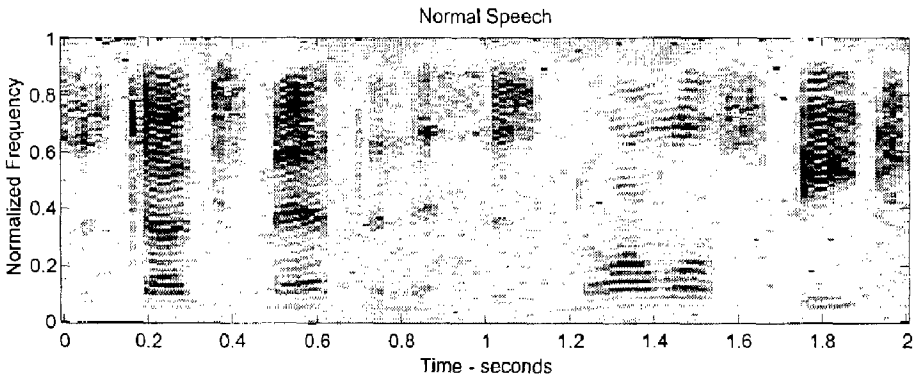
FIG. 1A depicts a spectrogram for normal speech.
Figure 1B:
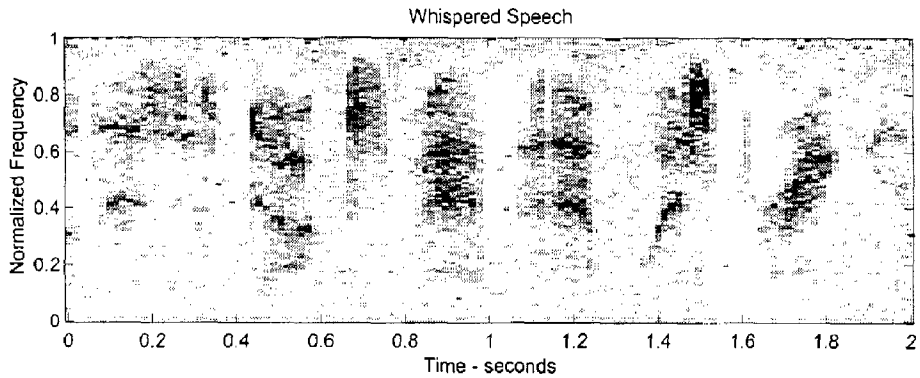
FIG. 1B depicts a spectrogram for whispered speech.

Referring to FIG. 1A and FIG. 1B typical spectrograms for normal speech and whispered speech, respectively, for the same male speaker (8 kHz sampling rate) are shown. Note that for the normal speech, there is higher magnitude at the lower frequencies and more harmonic structure compared to the whispered speech. Whispered speech is consistently more noise-like with reduced signal in the low frequency regions because it is generally unvoiced (aperiodic) with restricted airflow.

Figure 2:
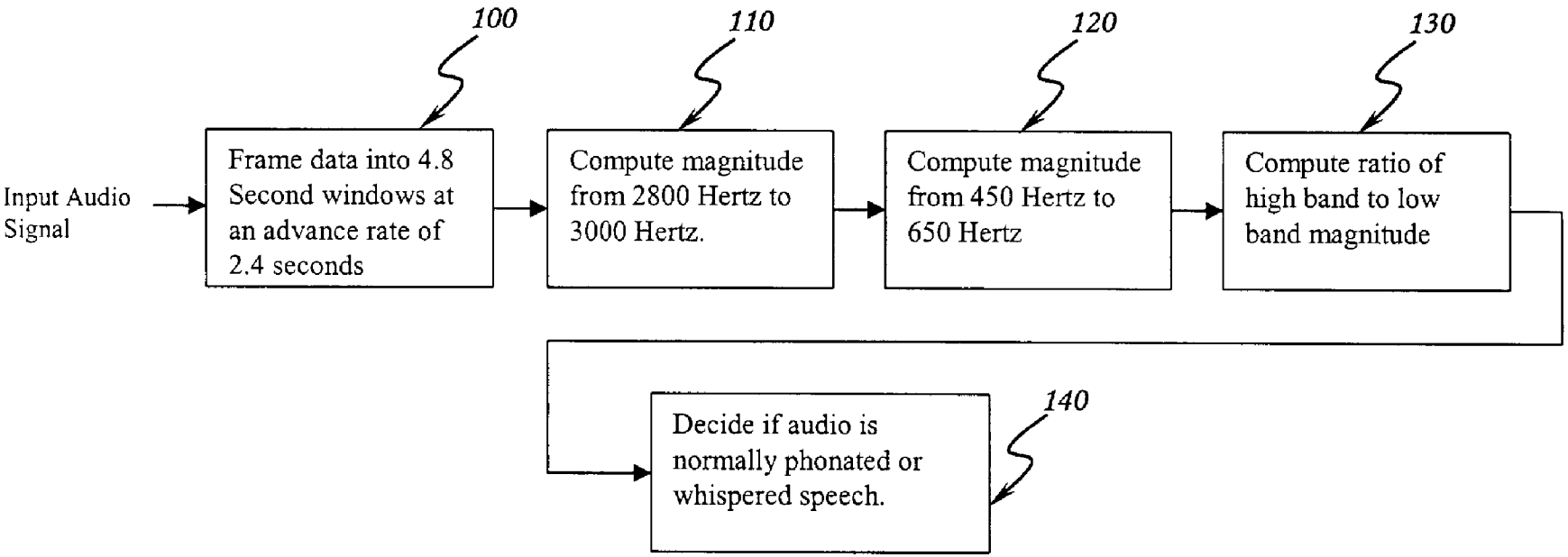
FIG. 2 depicts a block diagram for determining normal speech from whispered speech.

Further examination of spectrograms like these shows that whispered speech signals have magnitudes much lower than normal speech in the frequency region below 800 Hz. However, using the whole 800 Hz band could produce erratic results. For instance, in telephone speech, where the voice response of the system could drop off rapidly below 300 Hz, there could be little difference in signal magnitude in the 0-800 Hz band between whispered conversation and normal speech conversation. This is because the magnitude below the 300 Hz voice cutoff frequency is predominantly noise (usually 60 Hz power line hum components). When measurements are made over the whole 0-800 Hz band, the noise signal can dominate the band for whispered speech signals to a degree that prevents classification. To eliminate this problem, a frequency band is selected that is within the bandwidth of all voice communication systems and is broad enough to capture the speech magnitude independent of the speaker characteristics and the content of the conversation. Through observation, a 450 to 650 Hz frequency band was selected. However, in order to capitalize on the difference in signal magnitude between whispered and normal speech in the 450-650 Hz band, it is necessary to establish some relative measure of the strength of the signal. Since both normal and whispered speech have high frequency components, a band that could represent the high frequency signal level so that we could form a ratio of high frequency to low frequency magnitude and thus normalize the measurement, is preferred. Through observations of both normal and whispered speech spectrograms, the 2800-3000 Hz band, which is within the bandwidth of voice communication systems, was chosen. The method is depicted in FIG. 2 where a ratio of absolute magnitude in the high bands (2800-3000 Hz) to the magnitude in the low bands (450-650 Hz) is formed. For normal speech, there is a significant amount of signal in the low band. Thus, the ratio would generally be below 1.0. For whispered speech, the signal in the high band is generally greater than the signal in the low band. Thus, the ratio would generally be greater than 1.0. Through threshold experimentation, a ratio of 1.2 was selected. When the magnitude ratio is 1.2 or below, the signal is classified as normally phonated speech. When the magnitude ratio is greater than 1.2, the signal is classified as whispered speech.

Referring to FIG. 2, description of the block diagram follows. Data is framed 100 into 4.8 second windows that advance at a rate of 2.4 seconds (50% overlap). The magnitude is then computed 110 in the 2800 Hz to 3000 Hz frequency range. For a sampling rate of Fs and an N-point Discrete Fourier Transform, the starting point is given by 2800/(Fs/N) and the stopping point is 3000/(Fs/N) The magnitude used for this technique is the average absolute magnitude of the frequency samples between 2800-3000 Hertz. The magnitude is then computed 120 in the 450 Hz to 650 Hz frequency range. For a sampling rate of Fs and an N-point Discrete Fourier Transform, the starting point is given by 450/(Fs/N) and the stopping point is 650/(Fs/N). The magnitude used for this technique is the average absolute magnitude of the frequency samples between 450-650 Hertz. The ratio of high frequency band magnitude to low frequency band magnitude is next computed 130, where the audio signal is scored for classification. If the ratio for the window is less than or equal to 1.2, the audio signal for the window is labeled 140 normally phonated speech. If the audio signal is greater than 1.2, the audio signal for the window is labeled 140 whispered speech. Since unvoiced speech can have characteristics similar to whispered speech, 3 of the last 5 windows must be greater than 1.2 in order to classify a region of audio as whispered speech. The audio signal will continue to be labeled 140 as whispered speech as long as the ratio measurement 130 in 3 of the last 5 windows is greater than 1.2.

Referring to FIG. 3, test results are shown from computing the absolute magnitude ratio, the features are independent of signal level. Note that for this ratio method, the performance is extremely good for all SNRs (30 dB, 20 dB, 10 dB, and 5 dB). The mistakes that were made were in classifying whispered speech as normal speech. At no time was normal speech classified as whispered speech. That is, there were no whispered speech false alarms.

The test data consisted of telephone conversations between two people. In total, there were 20 male and 4 female speakers. The conversations were scripted and transitioned several times between speaking modes. For each conversation, there were five regions of either normal or whispered speech (normal-whispered-normal-whispered-normal). Thus, for each SNR level, there were a total of 60 regions (36 normal and 24 whispered regions) of interest for classification.

An examination of the whispered audio data that produced the errors found that these so called whispered regions were not whispered, but were instead softly spoken pronated speech. During data collection, speakers were instructed to whisper during parts of the conversation and to speak normal in other parts of the conversation. However, some speakers spoke the marked whispered regions in a reduced volume, using pronated speech rather than whispered speech as marked. These low volume regions were detected as normal speech by the algorithm instead of whispered speech. In the true definition of whispered speech, that is, speech produced without pronation (vibrating the vocal cords), the classifier did not produce any errors over the 240 test regions (60 regions×4 different SNR levels) evaluated at SNRs of 5 dB, 10 dB, 20 dB and 30 dB.

While the preferred embodiments have been described and illustrated, it should be understood that various substitutions, equivalents, adaptations and modifications of the invention may be made thereto by those skilled in the art without departing from the spirit and scope of the invention. Accordingly, it is to be understood that the present invention has been described by way of illustration and not limitation.

What is claimed is:

1. Method for detecting illicit activity comprising:

classifying whispered and normally phonated speech by determining the relative amounts of fricative and formant energy in each of two separate bandwidth samples of said speech wherein said step of determining further comprising the steps of:

framing an input audio signal into 4.8 second data windows and advancing said windows at a rate of 2.4 seconds;

computing the magnitude of said data over a high frequency range from 2800 hertz to 3000 hertz;

computing the magnitude of said data over a low frequency range from 450 hertz to 650 hertz;

computing the ratio of the said magnitude from said high frequency range to the said magnitude from said low frequency range by performing an N-point Discrete Fourier Transform; and determining if said ratio is greater than 1.2;

IF said ratio is greater than 1.2, THEN labeling said audio signal as whispered speech; and categorizing the activity as illicit;

OTHERWISE, labeling said audio signal as normally phonated speech; and categorizing the activity as non-illicit.

2. Apparatus for detecting illicit activity comprising:

means for classifying whispered and normally phonated speech; by determining the relative amounts of fricative and formant energy in each of two separate bandwidth samples of said speech, wherein said means for determining further comprising:

means for framing an input audio signal into 4.8 second data windows and advancing said windows at a rate of 2.4 seconds;

means for computing the magnitude of said data over a high frequency range from 2800 hertz to 3000 hertz;

means for computing the magnitude of said data over a low frequency range from 450 hertz to 650 hertz;

means for computing the ratio of the said magnitude from said high frequency range to the said magnitude from said low frequency range by performing an N-point Discrete Fourier Transform; and means for determining if said ratio is greater than 1.2; where IF said ratio is greater than 1.2, THEN means for labeling audio signal as whispered speech; and means for categorizing the activity as illicit;

OTHERWISE, means for labeling audio signal normally phonated speech; and means for categorizing the activity as non-illicit.

* * * * *